United States Patent [19]

Cole

[11] Patent Number: 4,714,030

[45] Date of Patent: Dec. 22, 1987

[54] SECURITY CABINET WITH DISGUISED ELECTRONIC CONTROL PANEL

[75] Inventor: David M. Cole, Roanoke, Va.

[73] Assignee: Tread Corporation, Roanoke, Va.

[21] Appl. No.: 677,219

[22] Filed: Dec. 3, 1984

[51] Int. Cl.[4] ..... E05G 1/04; E05B 49/00

[52] U.S. Cl. ..... 109/61; 109/59 T; 70/278; 70/283; 70/DIG. 81

[58] Field of Search ..... 109/6, 7, 59 R, 59 T, 109/61, 62, 74; 70/279, 282, 283, DIG. 81, 278; 361/179

[56] References Cited

U.S. PATENT DOCUMENTS

| | | | |
|---|---|---|---|
| 3,677,043 | 7/1972 | Cox | 70/283 |
| 3,764,982 | 10/1973 | Kidnocker, Jr. | 361/179 |
| 3,772,574 | 11/1973 | Hughes | 70/DIG. 81 |
| 3,885,408 | 5/1975 | Clark, Jr. | 70/278 |
| 4,148,092 | 4/1979 | Martin | 70/283 |
| 4,161,870 | 7/1979 | Barnes | 70/278 |
| 4,446,798 | 5/1984 | Withington | 109/61 |

*Primary Examiner*—Neill Wilson

*Attorney, Agent, or Firm*—Bell, Seltzer, Park & Gibson

[57] ABSTRACT

A security cabinet of metal construction having first and second series of locking members inside of and adjacent respective opposite side edges of the cabinet door. An electrically operable latching device maintains the cabinet door in a locked closed position. For unlocking the door, an electronic control device is provided including a disguised control panel mounted on the outer face of the door and being electrically connected to the latching device. The disguised control panel has a visually hidden array of switches thereon arranged so that a predetermined preselected sequence of actuation of the switches effects actuation of the latching device for movement thereof from a latched position to an unlatched position for permitting retraction of locking members by manual movement of the handle on the door to thereby permit the door to the cabinet to be opened.

10 Claims, 17 Drawing Figures

SECURITY CABINET WITH DISGUISED ELECTRONIC CONTROL PANEL

The present invention relates to security cabinets, and more particularly to security cabinets which include a disguised electronic control panel.

In recent years, security cabinets used in the home have become increasingly popular and commonplace because of the convenience to the homeowner, obviating the need for trips to such places as banks to use lock boxes. With the prevalence of unauthorized entries into houses and burglaries and the like, it is desirable to have the greatest possible degree of security for such cabinets, particularly in regard to the locking mechanism of the cabinet. However, if the type or location of the locking device is apparent to an unauthorized party who is seeking access to the cabinet, it is more vulnerable to unauthorized access.

With the foregoing in mind, it is the primary object of this invention to provide a security cabinet which is so constructed as to hide and disguise the construction and nature of the locking features present on the cabinet to thereby make the cabinet less vulnerable to unauthorized access.

It is a more specific object of this invention to provide a cabinet of metal construction including in combination therewith hidden locking means adjacent opposite side edges of the cabinet's access door, with electronic control means operably connected with the locking means via a latching means, and wherein the electronic control means includes a readily manually actuable disguised array of switches on the outside of the door arranged so that a predetermined, preselected sequence of actuation of the array of switches will effect actuation of the latching means for movement thereof from a latched position to an unlatched position for permitting operation of the locking means adjacent the door, by manipulation of a handle means mounted on the outside of the door, to permit the cabinet door to be opened.

These and other objects and advantages are achieved in the embodiments of the invention described herein by the provision of a security cabinet of metal construction having a front wall including a door frame and a doorjamb, to accommodate an access door hingedly connected to the metal cabinet along one side of the doorjamb. First and second locking means are mounted adjacent respective opposite side edges of the door and cooperate with the doorjamb to maintain the door in a locked position when it is closed. The locking means adjacent the free side edge of the door remote from the hinged side edge is movable from a retracted, unlocked position to an extended locked position engaging the doorjamb. A handle is movably mounted on the outside of the door and is operable, through interconnecting means responsive to movement of the handle, for moving the movable locking means to either the locked or unlocked position. Electrically operable latching means connected to the interconnecting means normally maintains the interconnecting means in a latched position for maintaining the cabinet door in the locked, closed position. Electronic control means, including a disguised control panel mounted on the outer surface of the door is electrically connected to the latching means and includes a disguised control panel having a visually hidden array of switches thereon arranged so that a predetermined, preselected sequence of actuation of the switches effects actuation of the latching means for movement thereof from the latched to the unlatched position which permits retraction of the movable locking means by a manual movement of the handle on the door so that the cabinet door may be opened.

In order to unlock and open the security cabinet by moving the movable locking means from the locked to the unlocked position, the visually hidden array of switches in the disguised electronic control panel carried on the outer surface of the cabinet door must be actuated in the predetermined, preselected sequence. Upon completion of the actuation of the switches in the predetermined sequence, the latching means is electronically actuated for movement of the movable locking means from the locked to the unlocked position. Retraction of the movable locking means from the locked to the unlocked position is thereby permitted by manual movement of the handle on the door through the interconnecting means connecting the latching means and the handle.

Some of the objects and features of the invention having been stated, others will appear as the description proceeds, when taken in connection with the accompanying drawings, in which—

Figure 4:
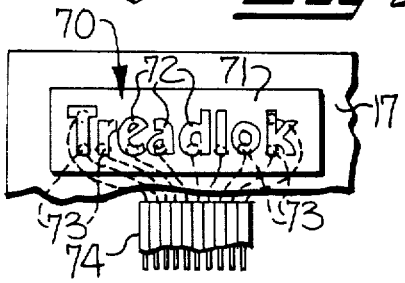
FIG. 4 is an enlarged, fragmentary front elevational view of the upper left-hand corner portion of the door shown in FIG. 1 showing the disguised electronic control panel, with a portion of the door broken away to reveal the wiring behind the door.
Figure 5:
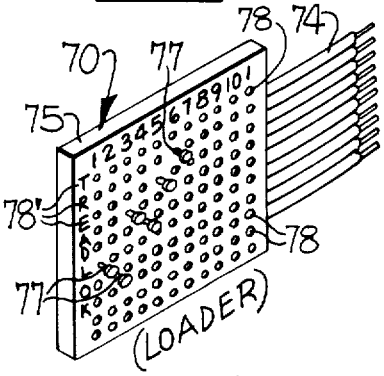
FIG. 5 is an enlarged, fragmentary, isometric view of the selectively programmable pinboard.
Figures 10, 11, 12:
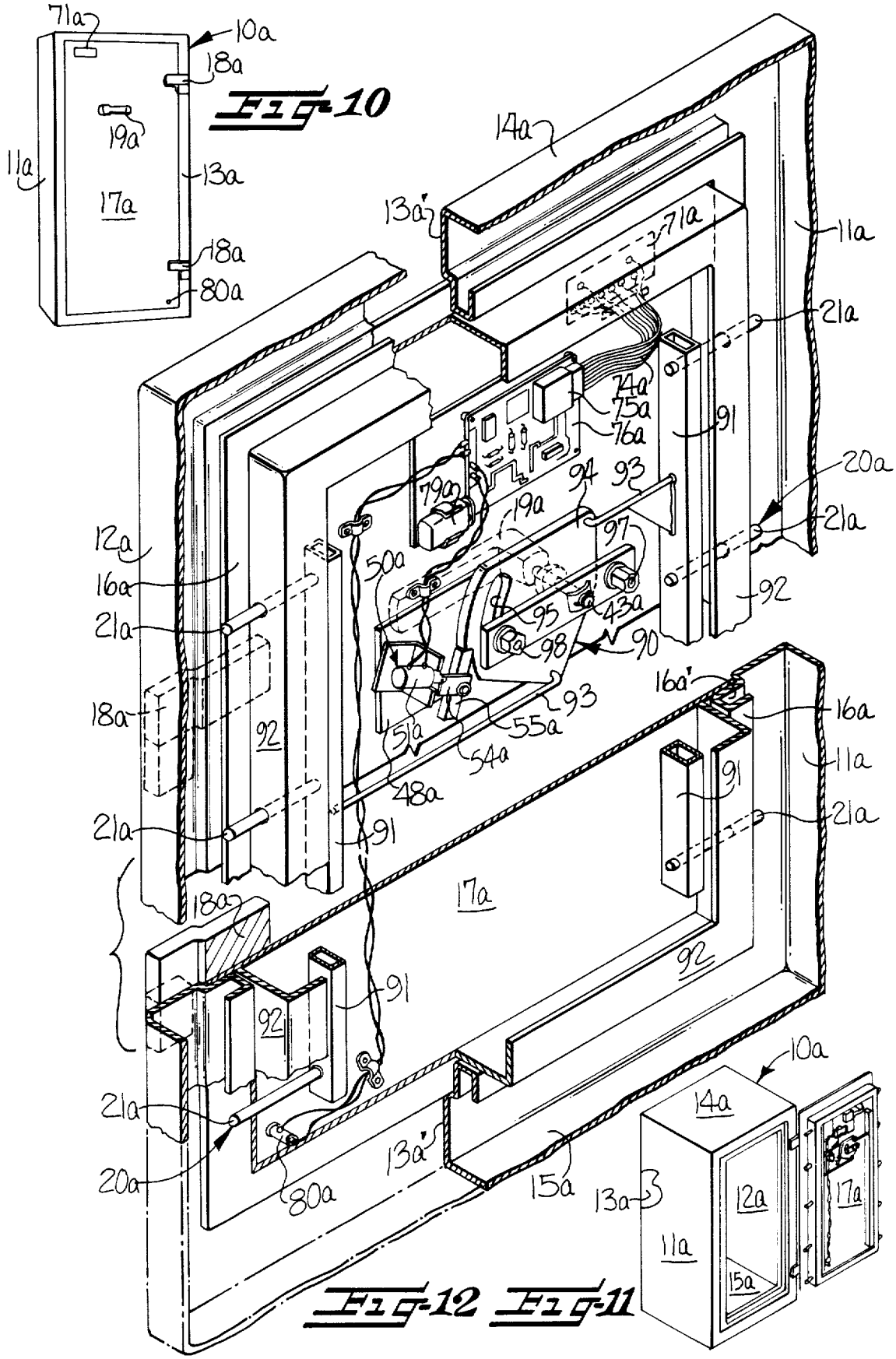
FIG. 10 is a view similar to FIG. 1, but showing a second embodiment of the invention.
FIG. 11 is a view similar to FIG. 2 of the second embodiment of the invention illustrating the door in opened, unlocked position.
FIG. 12 is a view similar to FIG. 3 of the second embodiment of the invention illustrating the door in locked position with the cabinet broken away to expose the inside of the door.
Figure 16:
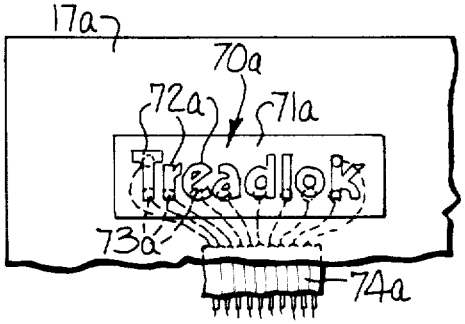
Figure 17:
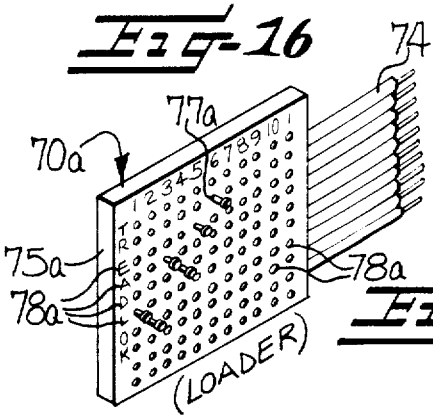

FIG. 16 is a view, similar to FIG. 4, of the second embodiment of the invention illustrating the upper left-hand corner portion of the door shown in FIG. 10 showing the disguised electronic control panel with a portion of the door broken away to reveal the wiring behind the door; and FIG. 17 is a view, similar to FIG. 5, of the second embodiment of the invention illustrating the selectively programmable pinboard.

Referring generally to the drawings, FIGS. 1–9 illustrate a first embodiment of the invention and FIGS. 10–17 illustrate a second embodiment. In the first embodiment of this invention locking means is provided adjacent the hinged side edge of the door which comprises a series of fixedly mounted locking members which cooperate with a doorjamb when the door is closed to maintain the cabinet door in a locked, closed position. Locking means is also provided adjacent the free side edge of the door which comprises a series of spaced-apart movable locking members. In the second embodiment of the invention, the locking means adjacent each of both the free side edge and the hinged side edge of the door comprises a series of vertically spaced movable locking members.

Figure 1:
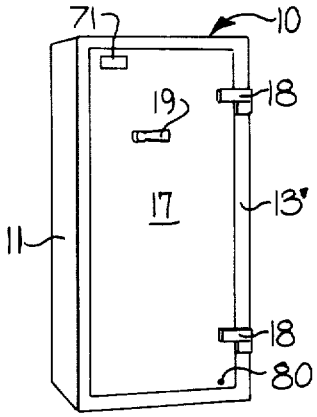
FIG. 1 is a perspective view of a cabinet incorporating one embodiment of the present invention and illustrating the door in closed position.
Figure 2:
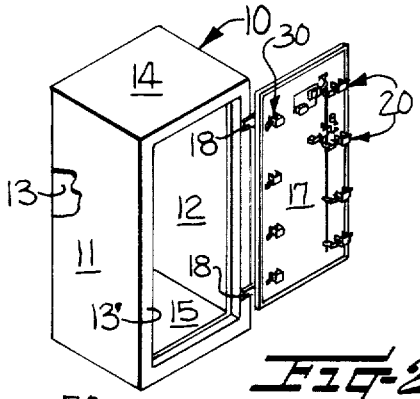
FIG. 2 is an isometric view of the cabinet of FIG. 1 illustrating the door in open, unlocked position.

Referring more particularly to FIGS. 1 and 2, reference numeral 10 broadly indicates a metal security chest of the upright type having opposing pairs of side walls 11, 12, a back or rear wall 13, a front wall 13', and top and bottom walls 14 and 15, respectively. The front wall of the cabinet is provided with a doorjamb 16 including door stop means 16' defining an opening in the front wall 13' for an access door 17 which is carried by conventional hinges 18 secured to front wall 13'. A conventional, hand-engagable door handle 19 is located on the outer surface of the door 17.

Figure 3:
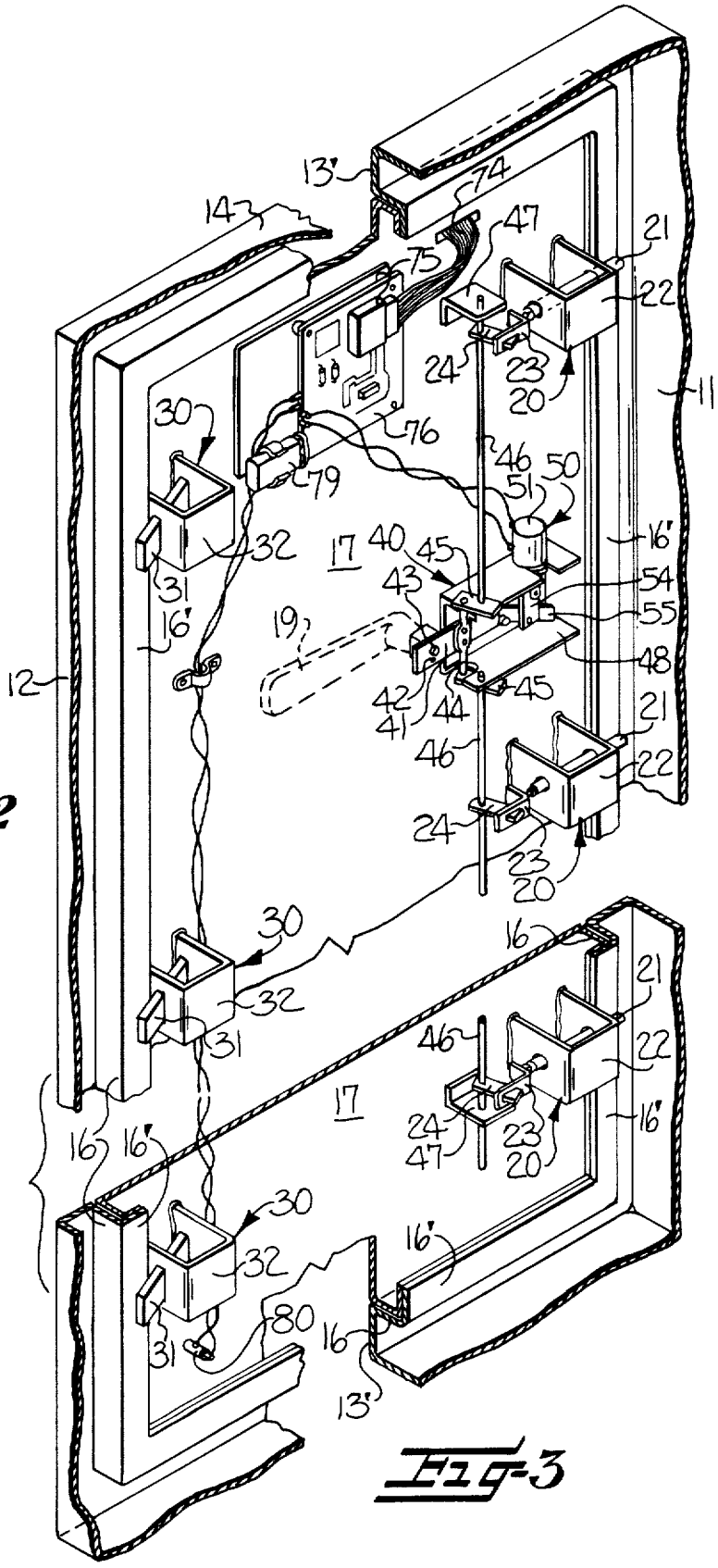
FIG. 3 is an enlarged, fragmentary, isometric view of the door in locked position with the cabinet broken away to expose the inside of the door.
Figure 6:
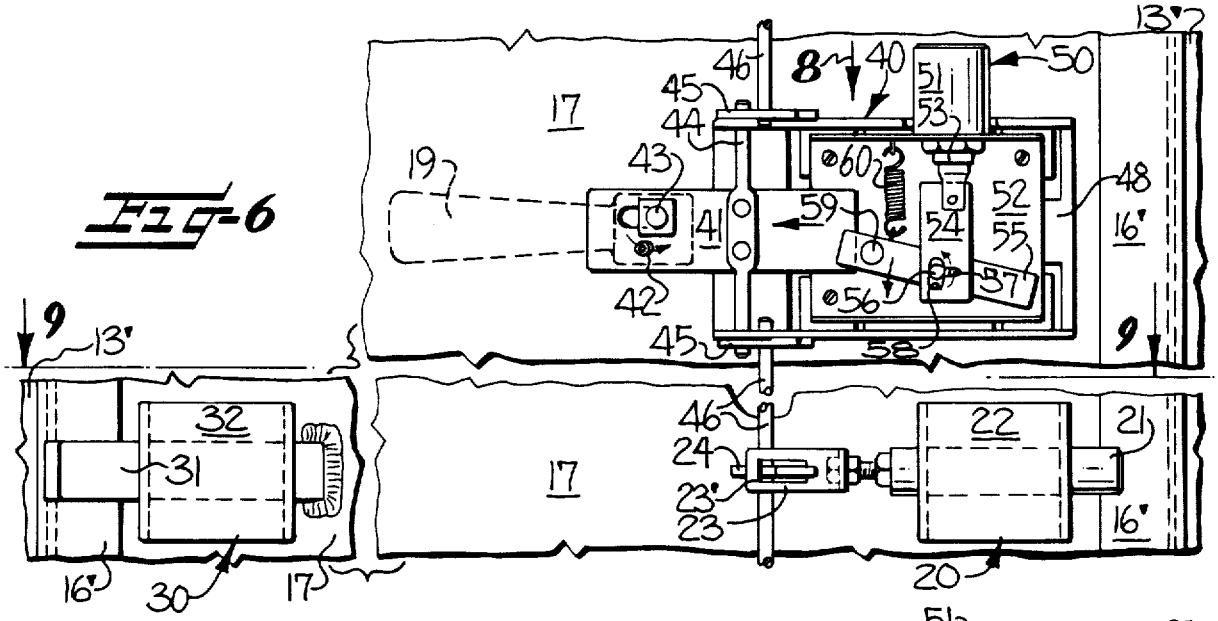
FIG. 6 is an enlarged, fragmentary elevational view illustrating the cooperating door locking means and latching means in locked position.
Figure 7:
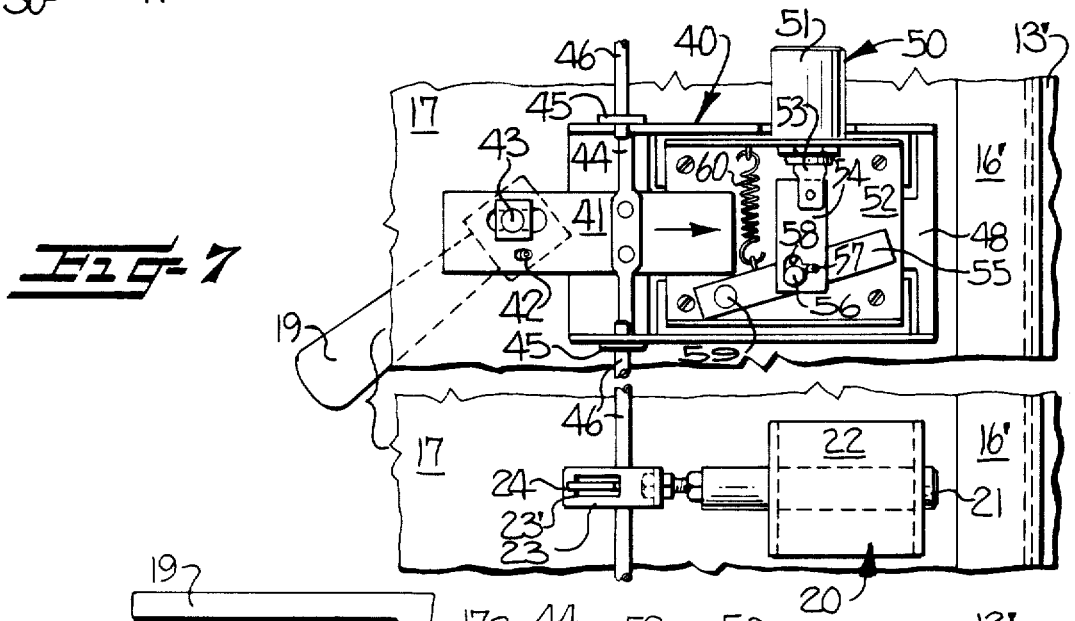
FIG. 7 is a view similar to FIG. 6, showing the door locking means in unlocked position.

As depicted in FIGS. 3, 6 and 7 first locking means 20 and second locking means 30 are carried at spaced-apart, parallel locations adjacent respective opposite side edges of the door 17. First locking means 20 is carried at vertically spaced apart locations adjacent the edge of the door 17 opposite from the hinged side thereof and comprises movable parallel locking pins 21 which are maintained in position by and are slideably held within respective guide supports 22 suitably secured on the inside of the door 17. Each locking pin 21 is connected to a slotted member 23. A crank 24 adjacent each locking pin 21 is secured on an upright connecting rod 46 so that the free end of each crank 24 is maintained within a slot 23' of the respective slotted member 23. Since cranks 24 are secured on the respective rods 46, upon rotation of the connecting rod 46 during the locking or unlocking procedure, the locking pins 21 are moved between the locked and unlocked position as a group.

Second locking means 30 is carried at vertically spaced-apart locations on and adjacent the hinged side of the door 17 and comprises generally parallel locking members in the form of locking bars 31 which are fixedly mounted in respective support brackets 32 attached to the inside of the door 17. The free end portions of locking bars 31 extend angularly behind, and thereby overlie, the door stop 16' and the other end portions of locking bars 31 are suitably secured to the inside of the door 17.

Figure 9:
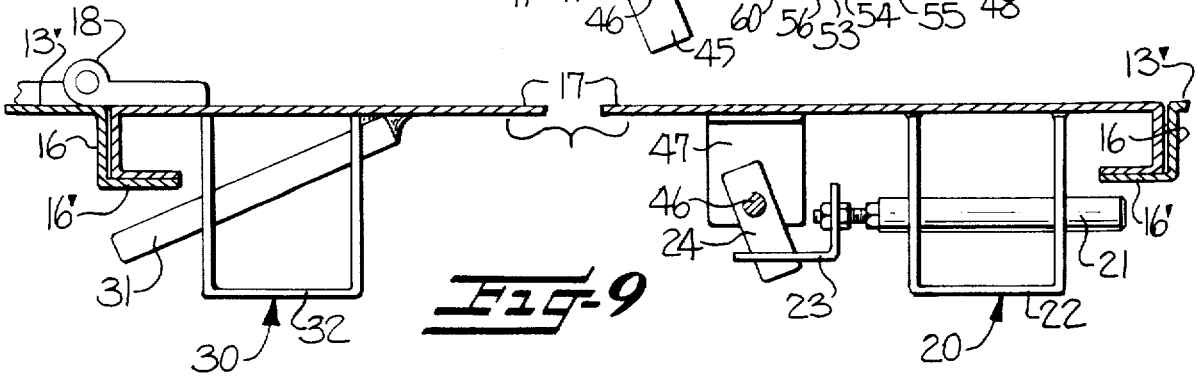
FIG. 9 is a fragmentary sectional plan view taken along the line 9—9 of FIG. 6.

Referring more particularly to FIG. 9, it will be seen that, when the door 17 is in closed and locked position, locking bars 31 cooperate with the doorjamb 16, with the free end portion of each locking bar 31 extending angularly behind the door stop 16'. Adjacent the free side edge of door 17, locking pins 21 extend inwardly of and overlap the doorjamb 16 when the door is in closed and locked position. Consequently, should a person seeking unauthorized access to the inside of the cabinet 10 break the door hinges 18, the door 17 would still be maintained in closed and locked position by means of the cooperation of locking bars 31 and locking pins 21 with the doorjamb 16.

Figure 8:
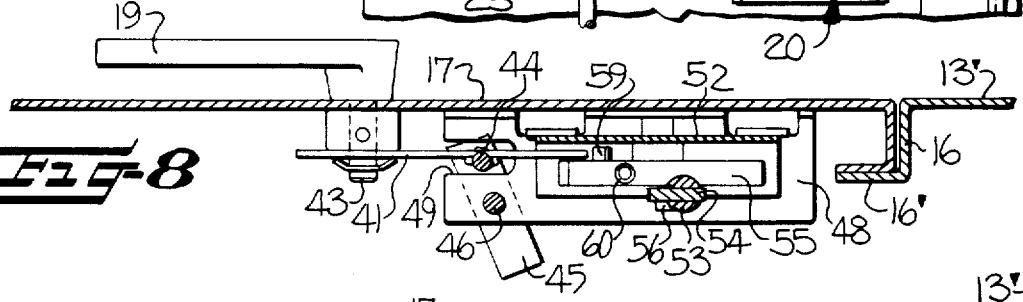
FIG. 8 is a fragmentary, sectional plan view taken looking generally in the direction of the arrow 8 in FIG. 6.

Referring now to FIGS. 3 and 6 through 8, interconnecting means 40, connecting the handle 19 with electrically operable latching means 50, comprises a movable connecting member 41 mounted on the inside of the door 17 and connected to the handle 19 in association with an offset handle pin 42 which is offset from a bolt 43 about which the handle 19 pivots. The offset pin 42 is fixed with respect to handle 19 so that, upon turning handle 19 downwardly from the locked to the unlocked position, the connecting member 41 moves laterally away from the axis of handle 19 or from left to right in FIG. 6. An upright extension rod 44 is secured to connecting member 41 and loosely penetrates pivot plates 45 arranged so as to rotate end portions of, and in fixed relation to, upright connecting rods 46. The pivot plates 45 are connected to extension rod 44 at a position offset from the point about which pivot plates 45 rotate as shown in FIG. 8. The distal ends of connecting rods 46 are retained between and journaled in connecting rod brackets 47, and proximal end portions of connecting rods 46 are journaled in spaced upper and lower flanges of a mounting bracket 48 attached to door 17. Slots 49 are provided in the end portions of the flanges of mounting bracket 48 so that extension rod 44 may readily move between the locked and unlocked positions.

Upon turning handle 19 downwardly from the locked position of FIG. 6 to the unlocked position of FIG. 7, the connecting member 41 moves laterally outwardly and thus moves extension rod 44 therewith. This causes the pivot plates 45 and connecting rods 46 to move in fixed relationship and thereby effect movement of the pins 21 of the movable first locking means 20 from the locked position of FIGS. 6 and 9 to the unlocked position of FIG. 7.

Referring to FIGS. 3, 6 and 7, the electrically operable latching means 50, operably connected to interconnecting means 40, comprises a solenoid 51 whose stator or electromagnetic coil is attached to the inside of the door 17 by means of a mounting bracket 52. The solenoid 51 is electrically connected to a circuit board 76. An arm or armature 53 of the solenoid 51 is attached to an extension bar 54. A latching bar 55 is pivotally connected to the inside of the door 17 or mounting bracket 52 by means of a pivot pin 56. An end portion of the pivot pin 56 and an offset pin 57 are contained within a slot 58 in the end portion of extension bar 54 opposite from that to which the arm 53 is connected. The offset pin 57 is mounted on or in a medial portion of latching bar 55. A latching pin 59 also is carried on the inward end portion of the latching bar 55 nearest the center of the door 17 and is in abutting relationship with connecting member 41 when member 41 occupies the locked position, thus preventing outward movement of connecting member 41. Upon energization of solenoid 51 to unlock the cabinet 10, the solenoid arm 53 moves upwardly from the extended to the retracted position, causing offset pin 57 to rotate latching bar 55 counterclockwise (FIGS. 6 and 7) about pivot pin 56, as shown in comparison of FIGS. 6 and 7. Such rotation of latching bar 55 moves latching pin 59 downwardly out of abutting relationship with connecting member 41 thereby allowing movement of the connecting member 41 by manual downward pivotal movement of door handle 19. A spring 60 biases latching bar 55 upwardly to the locked position as the handle 19 is subsequently returned to the locked position so that the cabinet door 17 may not be reopened without first repeating the entire unlocking procedure.

Referring now to FIGS. 3 and 4, electronic control means 70, electrically connected to latching means 50, comprises a disguised electronic control panel 71 carried on the upper portion of the outside of door 17. Indicia 72, depicted as a series of letters in FIG. 4, are visibly located on the panel 71. The electronic control panel defines a visible face plate having a readable display thereon. Conventional pressure-sensitive membrane switches 73 are hidden below or behind the outer surface of the disguised electronic control panel 71. The pressure-sensitive switches 73 are electrically connected by wiring 74 to a selectively programmable pinboard 75 (FIG. 5) of a circuit board 76, which is carried on the inside of door 17, as shown in FIG. 3.

To predetermine and preselect the sequence in which the pressure-sensitive switches 73 are to be activated, the owner of the cabinet 10 or some other authorized person inserts shorting pins 77 into holes 78 in the selectively programmable pinboard 75, as illustrated in FIG. 5. The holes 78 are shown arranged in vertical and horizontal rows, which rows may be indentified by suitable, sequentially arranged indicia 78', such as letters or other symbols which may correspond to those indicia 72 appearing on the electronic control panel 71. The numbers 1–7 above the vertical rows of holes 78 may represent the order in which the pressure-sensitive switches 72 of the panel 71 are to be actuated or pressed in order to actuate electronic means 70. It should be noted that any sequence of letters or symbols may be selected and any letter or symbol may be selected as many times as desired by the owner or other authorized person.

Referring now to FIG. 3, it will be noted that a battery 79 is utilized as an internal power source which is connected to the circuit board 76 of electronic means 70, carried on the inside of door 17. This allows cabinet 10 to be a freestanding unit, not dependent upon access to an external power source such as an electrical outlet. Additionally, the cabinet 10 is provided with an auxiliary, externally accessible electrical outlet plug 80 located adjacent the bottom of the door in FIG. 3, and electrically connected to the circuit board 76 so that the electronic means 70 may be activated through an external power source being connected to plug 80 to enable the door 17 to be unlocked and opened should the battery 79 fail at any time to activate electronic means 70, when desired.

Regardless of whether the external power source or the battery 79 is used to activate the circuit of the circuit board 76, it should be noted that, upon an operator actuating the switches 73 in a predetermined sequence, according to the preselected positions of the shorting pins 77 (FIG. 5), current will flow from the power source through the circuit board 76, and thus, through the coil of solenoid 51, thereby momentarily energizing solenoid coil 51 to effect movement of the latching bar 55 of latching means 50 from the latched position of FIG. 6 to the unlatched position of FIG. 7 for permitting retraction of the locking pins 21 of the first locking means 20 by manual downward movement of the door handle, thereby permitting the door 17 to be opened.

Referring now to FIGS. 10–17 wherein the second form of the invention is illustrated, this form of the invention uses the same reference numerals for the same parts as the first form of the invention with the suffix "a" added thereto, where applicable, to avoid repetitive description. It will be understood that this form of the invention differs from the first embodiment in that the locking means carried adjacent both side edges of the door 17*a* comprise movable locking pins 21*a* of the general type comprising the first locking means 20 of the first embodiment of the invention.

Figure 13:
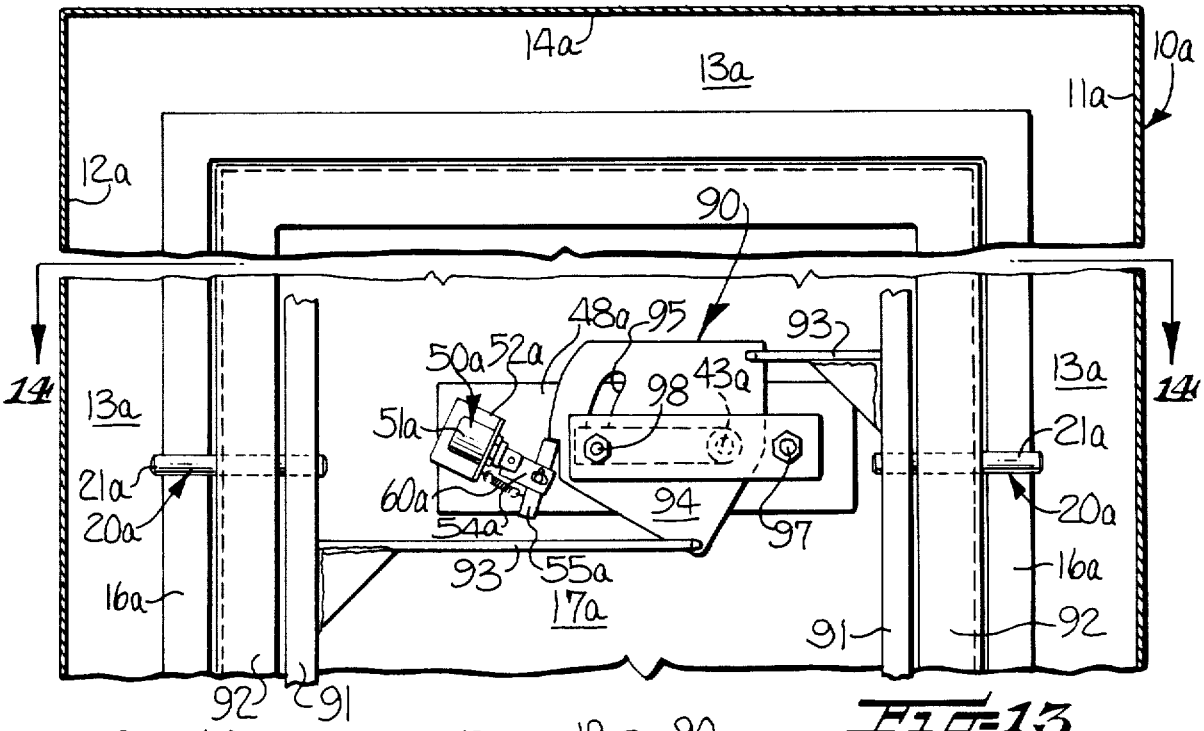
FIG. 13 is an enlarged fragmentary elevational view similar to FIG. 6 showing the second embodiment of the invention illustrating the cooperating door locking means and latching means in locked position.

Additionally, interconnecting means 90 is structured and arranged differently from interconnecting means 40 of the first form, as shown more particularly in FIG. 13. In the second form, respective series of locking pins 21*a* are carried adjacent both side edges of the door 17*a* by upright support members 91, which locking pins 21*a* pass through and are guided by bracket means 92 secured to the inside of the door 17*a*.

Figure 14:
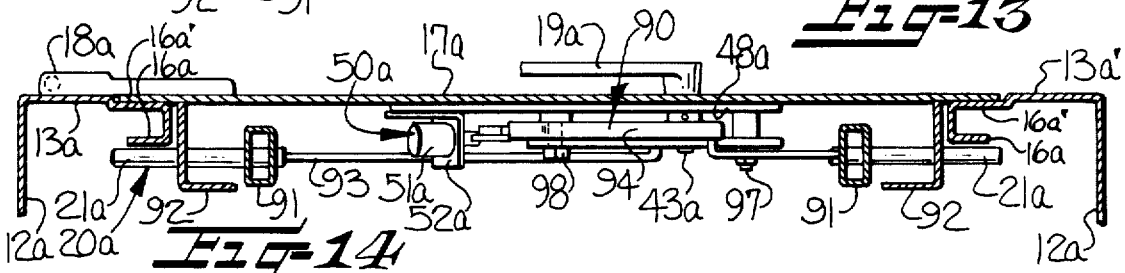
FIG. 14 is a sectional view similar to FIG. 8, of the second embodiment of the invention taken substantially along the line 14—14 of FIG. 13.

The locking pins 21*a* overlie and are positioned inwardly of the doorjamb 16*a* when in locked position, as shown in FIG. 12–14. Connecting rods 93 are connected between support members 91 and lever means 94. The lever means 94 is fixedly connected to the door handle 19*a* by means of handle pivot bolt 43*a* rotatably mounted in door 17*a*. A slot 95 is formed in the lever means 94 on the opposite side portion thereof from that at which connecting rods 93 are attached thereto.

The handle 19*a* is attached to and maintained in position by a support bar 96 which is attached to the inside of the door 17*a* but is spaced therefrom, with the support bar 96 being parallel to the inside of the door 17*a*. The bar 96 is maintained in position by bolts 97 and 98 which are attached to the inside of the door 17*a* by means of mounting bracket 48*a*. The bolt 98, which is located adjacent the vertical center or middle of the door 17*a*, also loosely penetrates the slot 95 in the lever means 94 so that, upon rotation of the handle 19*a* downwardly, lever means 94 may rotate with handle 17*a* about handle pivot bolt 43*a*. The rotation or angular movement, of the lever means 94 is guided by the bolt 98 within slot 95 of lever means 94. The manual rotation downwardly of handle 19*a* from the locked to the unlocked position rotates lever means 94 therewith and moves support members 91 inwardly toward the center of the door 17*a* thereby moving locking pins 21*a* inwardly into retracted, unlocked position with respect to the doorjamb 16*a*.

Figure 15:
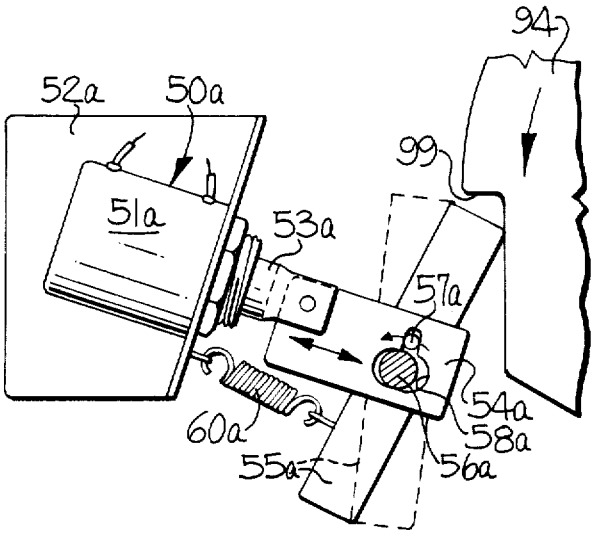
FIG. 15 is an enlarged fragmentary elevational view of the latching means of the second embodiment of the invention illustrating the cooperating latching means and interconnecting means.

It will be noted in FIG. 15 that the latching bar 53*a* of the latching means 50*a* maintains the lever means 94 of the interconnecting means in locked position by abutting a notched edge or shoulder 99 of lever means 94 so that the lever means 94 may not be rotated into an unlocked position while latching member 53*a* is in abutting position. This is accomplished without a latching pin 59 as used in the first embodiment.

It will thus be seen that a locking arrangement is provided so that the unlocking of the cabinet is dependent upon a person knowing that pressure-sensitive switches are located beneath the surface of the control panel and further knowing the preselected sequence of actuation of said switches so that the cabinet then may be manually unlocked by turning the handle on the cabinet door.

In the drawings and specification, there have been set forth embodiments of the invention, and although specific terms are employed, they are used in a generic and descriptive sense only and not for purposes of limitation.

That which is claimed is:

1. In a cabinet of metal construction and adapted to be used for protecting one's valuables, said cabinet having a front wall with an opening therein for accommodating a door, a doorjamb defining the door opening in the front wall and including door stop means along at least opposite sides thereof, and a door hingedly connected to said metal cabinet along one side of the doorjamb and adapted when closed to abut against the door stop means and close the opening, the combination therewith of first and second locking means mounted adjacent respective opposite side edges of said door and cooperating with said doorjamb when the door is closed to normally maintain the cabinet door in locked closed position, said first locking measn being adjacent the free side edge of the door remote from the hinged side edge of the door and being movable from a retracted unlocked postion, allowing the door to be opened, to an extended locked position for engaging the doorjamb and preventing outward movement of the door, handle means movably mounted on the outside of the door, means interconnecting said handle means and said first locking means and responsive to movement of said handle means relative to said door for moving said first locking means to either the locked or unlocked position, electrically operable latching means operably connected to said interconncting means and normally maintaining said interconnecting means in a latched position for maintaining the cabinet door in the locked closed position and comprising a solenoid mounted on the inside of the door and having a longitudinally movable arm, a latching bar pivotally connected to said door and normally positioned in latching engagement with said means interconnecting said handle means and said first locking means and pivotally moveable by said solenoid arm upon energization of said solenoid to an unlatching position, and electronic control means including a disguised control panel mounted on the outer face of said door and electrically connected to said latching means, said disguised control panel having a visually hidden array of switches thereon arranged so that a predetermined preselected sequence of actuation of said array of switches effect actuation of said latching means for movement thereof from said latched position to an unlatched position for permitting retraction of said first locking means by manual movement of the handle on the door to thereby permit the door to the cabinet to be opened, and wherein said electronic control means further includes a self-contained electrical power source carried inside the cabinet and further comprising an electrical outlet located on said cabinet and accessible from the outside of said cabinet and being connected to said electronic control means so that said electronic control means may be operated by a suitable external source of electrical power should the main power source included in said electronic control means not function properly when the cabinet is locked.

2. In a cabinet of metal construction and adapted to be used for protecting one's valuables, said cabinet having a front wall with an opening therein for accommodating a door, a doorjamb defining the door opening in the front wall and including door stop means along at least opposite sides thereof, and a door hingedly connected to said metal cabinet along one side of the doorjamb and adapted when closed to abut against said door stop means and close the opening, the combination therewith of first and second locking means mounted on the inside of said door adjacent respective opposite side edges of the door and cooperating with said doorjamb when the door is closed to normally maintain the cabinet door in locked position, and first locking means being adjacent the free side edge of the door remote from the hinged side edge of the door and comprising a series of spaced apart movable locking members movable from a retracted unlocked position allowing the door to be opened, to an extended locked position for engaging the doorjamb and preventing outward movement of the door, handle means movably mounted on the outside of the door, means interconnecting said handle means and said series of locking members of said first locking means and responsive to movement of said handle means relative to the door, for moving said series of locking members to either the locked or unlocked position, electrically operable latching means operably connected to said interconnecting means and normally maintaining said interconnecting means in a latched position for maintaining the cabinet door in the locked closed position and comprising a solenoid mounted on the inside of the door and having a longitudinally movable arm, a latching bar pivotally connected to said door and normally positioned in latching engagement with said means interconnecting said handle means and said first locking means and pivotally moveable by said solenoid arm upon energization of said solenoid to an unlatching position, and electric control means including a disguised control panel mounted on the outer face of said door and electrically connected to said latching means, said disguised control panel having a visually hidden array of switches thereon arranged so that a predetermined preselected sequence of actuation of said array of switches effects actuation of said latching means for movement thereof from said latched position to an unlatched position for permitting retracting said series of locking members by manual movement of the handle on the door to thereby permit the door to the cabinet to be opened, and wherein said electronic control means further includes a self-contained electrical power source carried inside the cabinet and further comprising an electrical outlet located on said cabinet and accessible from the outside of said cabinet and being connected to said electronic control means so that said electronic control means may be operated by a suitable external source of electrical power should the main power source included in said electronic control means not function properly when the cabinet is locked.

3. A cabinet according to claim 2 wherein said latching means comprises rotatable latching bar means connected to the inside of said door, a solenoid carried on the inside of said door, said solenoid normally being in the extended position with the door in latched condition and being movable to a retracted position, and an extension member operably connected to said latching bar means and to said solenoid such that upon the retraction movement of said solenoid, said latching bar means is pivoted to a position permitting said cabinet door to be opened.

4. A cabinet according to claim 2 wherein said disguised control panel of said electronic control means includes a visible face plate having a readable display thereon and wherein said hidden switches are behind the same and are pressure sensitive.

5. A cabinet according to claim 4 wherein said electronic control means includes switch programming means attached to the inside of said door for preselecting the sequence that said switches are to be pressed in order to effect actuation of said latching means.

6. In a cabinet of metal construction and adapted to be used for protecting one's valuables, said cabinet having a front wall with an opening therein for accommondating a door, a doorjamb defining the door opening in the front wall and including door stop means along at least opposite sides thereof, and a door hingedly connected to said metal cabinet along one side of the doorjamb and adapted when closed to abut against said door means and close the opening, the combination therewith of first and second locking means mounted on the inside of said door adjacent respective opposite side edges of the door and cooperating with said doorjamb when the door is closed to normally maintain the cabinet door in locked closed position, said first locking means being adjacent the free side edge of the door remote from the hinged side edge of the door and comprising a series of spaced part movable locking members movable from a retracted, unlocked position allowing the door to be opened, to an extended locked position for engaging the doorjamb and preventing outward movement of the door, and said second locking means being adjacent the hinged side of the door and comprising a series of locking members fixedly mounted on the inside of said door and being positioned to cooperate with said doorjamb when the door is closed and normally maintaining the cabinet door in locked closed position, handle means movably mounted on the outside of the door, means interconnecting said handle means and said series of locking members of said first locking means and responsive to movement of said handle means relative to the door, for moving said first series of locking members to either the locked or unlocked position, electically operable latching means operably connected to said interconnecting means and normally maintaining said interconnecting means in latched position for maintaining the cabinet door in the locked closed position and comprising a solenoid mounted on the inside of the door and having a longitudinally movable arm, a latching bar pivotally connected to said door and normally positioned in latching engagement with said means interconnecting said handle means and said first locking means and pivotally moveable by said solenoid arm upon energization of said solenoid to an unlatching position, and electronic control means including a disguised electronic control panel mounted on the outer face of said door and electrically connected to said latching means, said disguised electronic control panel having a visually hidden array of switches thereon arranged so that a predetermined preselected sequence of actuation of said array of swithes effects actuation of said latching means for movement thereof from said latched position to an unlatched position for permitting retraction of said first series of locking members by manual movement of the handle on the door to thereby permit the door to the cabinet to be opened, and wherein said electronic control means further includes a self-contained electrical power source carried inside the cabinet and further comprising an electrical outlet located on said cabinet and accessible from the outside of said cabinet and being connected to said electronic control means so that said electronic control means may be operated by a suitable external source of electrical power should the main power source included in said electronic control means not function properly when the cabinet is locked.

7. In a cabinet of metal construction and adapted to be used for protecting one's valuables, said cabinet having a front wall with an opening therein for accommodating a door, a door jamb defining the door opening in the front wall and including door stop means along at least opposite sides thereof, and a door hingedly connected to said metal cabinet along one side of the doorjamb and adapted when closed to abut against said door stop means and close the opening, the combination therewith of first and second locking means mounted on the inside of the door adjacent respective opposite side edges of the door and cooperating with said doorjamb when the door is closed to normally maintain the cabinet door in locked closed position, said first locking means being adjacent the free side edge of the door remote from the hinged side edge of the door and said second locking means being adjacent the hinged side of the door and each of said locking means comprising a series of spaced apart, movable locking members movable from a retracted unlocked position allowing the door to be opened, to an extend locked position for engaging the doorjamb and preventing outward movement of the door, handle means movably mounted on the outside of the door, means interconnecting said handle means and each of said series of locking members and responsive to movement of said handle means relative to the door for moving each of said series of locking members to either the locked or unlocked position, electrically operable latching means operably connected to said interconnecting means and normally maintaining said interconnecting means in latched position for maintaining the cabinet door in the locked closed position and comprising a solenoid mounted on the inside of the door and having a longitudinally movable arm, a latching bar pivotally connected to said door and normally positioned in latching engagement with said means interconnecting said handle means and said first locking means and pivotally moveable by said solenoid arm upon energization of said solenoid to an unlatching position, and electronic control means including a disguised electronic control panel mounted on the outer face of said door and electrically connected to said latching means, said disguised electronic control panel having a visually hidden array of switches thereon arranged on that a predetermined preselected sequence of actuation of said array of switches effects actuation of said latching means for movement thereof from said latched position to an unlatched position for permitting retraction of each of said series of locking members by manual movement of the handle on the door to thereby permit the door to the cabinet to be opened, and wherein said electronic control means further includes a self-contained electrical power source carried inside the cabinet and further comprising an electrical outlet located on said cabinet and accessible from the outside of said cabinet and being connected to said electronic control means so that said electronic control means may be operated by a suitable external source of electrical power should the main power source included in said electronic control means not function properly when the cabinet is locked.

8. A cabinet according to claim 6 or 7 wherein said latching means comprises rotatable latching bar means connected to the inside of said door, a solenoid carried on the inside of said door, said solenoid normally being in the extended position with the door in latched condition and being movable to a retracted position and an extension member operably connected to said latching bar means and to said solenoid such that upon the retraction movement of said solenoid, said latching bar means is pivoted to a position permitting said cabinet door to be opened.

9. A cabinet according to claim 6 or 7 wherein said disguised electronic control panel of said electronic control means includes a visible face plate having a readable display thereon and wherein said hidden switches are behind said readable display and are pressure sensitive.

10. A cabinet according to claim 6 or 7 wherein said electronic control means includes switch programming means attached to the inside of said door for preselecting the sequence that said switches are to be actuated in order to effect actuation of said latching means.

* * * * *

UNITED STATES PATENT AND TRADEMARK OFFICE

CERTIFICATE OF CORRECTION

PATENT NO. : 4,714,030

DATED : December 22, 1987

INVENTOR(S) : David M. Cole

It is certified that error appears in the above-identified patent and that said Letters Patent is hereby corrected as shown below:

Column 7, Line 21, delete "measn" and insert --means--

Column 9, Lines 30 and 31, delete "door means" and insert --door stop means--

Column 10, Line 31, delete "door jamb" and insert -doorjamb--

Column 11, Line 10, delete "on" and insert --so--

Signed and Sealed this

Seventh Day of June, 1988

*Attest:*

*Attesting Officer*

DONALD J. QUIGG

*Commissioner of Patents and Trademarks*